United States Patent [19]

Tokumoto et al.

[11] 4,082,628

[45] Apr. 4, 1978

[54] METHOD OF ADJUSTING THE HARDNESS OF A TITANIUM METAL

[75] Inventors: Shin-ichi Tokumoto; Eiji Tanaka, both of Yokohama; Tatsuo Kikuchi, Hoya; Kenji Ogisu, Yokohama; Toshiro Tsumori, Tokyo, all of Japan

[73] Assignee: Sony Corporation, Tokyo, Japan

[21] Appl. No.: 690,058

[22] Filed: May 26, 1976

[30] Foreign Application Priority Data

May 27, 1975 Japan ..... 50-63738

[51] Int. Cl.[2] ..... C25C 3/28

[52] U.S. Cl. ..... 204/64 T

[58] Field of Search ..... 204/64 T

[56] References Cited

U.S. PATENT DOCUMENTS

| | | | |
|---|---|---|---|
| 2,757,135 | 7/1956 | Cleave et al. | 204/64 T |
| 2,845,386 | 7/1958 | Olson | 204/64 T |
| 2,858,258 | 10/1958 | McCawley | 204/64 T |
| 2,861,030 | 11/1958 | Slaten | 204/64 T |
| 2,920,027 | 1/1960 | Dean | 204/64 T |

*Primary Examiner*—John H. Mack
*Assistant Examiner*—H. A. Feeley
*Attorney, Agent, or Firm*—Lewis H. Eslinger; Alvin Sinderbrand

[57] ABSTRACT

In the electrodeposition of titanium metal from an electrolyte containing one or more dissolved or fused titanium chlorides and other dissolved or fused chloride salts, such as, $MgCl_2$,$CaCl_2$,NaCl, and the like; the hardness of the electrodeposited titanium is adjusted by adding to the electrolyte one or more oxides, such as titanium oxide and oxides of alkaline and alkaline-earth metals, and/or one or more fluorides of alkaline and alkaline-earth metals.

8 Claims, No Drawings

METHOD OF ADJUSTING THE HARDNESS OF A TITANIUM METAL

BACKGROUND OF THE INVENTION

1. Field of the Invention

The present invention relates generally to a method of adjusting the hardness of a titanium metal, and more particularly to a method of adjusting the hardness of a titanium metal obtained by a fused-salt electrodeposition method.

2. Description of the Prior Art

In general, it is well known in the art that the hardness of metal depends greatly on an amount of impurities or additives in the metal. In the case of titanium metals, if an interstitial atom such as oxygen, nitrogen and the like is contained in titanium, the hardness of the titanium is greatly increased as compared with the hardness of titanium containing no interstitial atoms. Accordingly, titanium metal which contains oxygen or the like to increase its hardness and its mechanical strength is effective from the practical standpoint and hence is widely used. However, when too much oxygen is contained in itianium the hardness of the titanium is increased remarkably, but the ductility thereof is deteriorated. Thus, titanium containing too much oxygen cannot be used practically without considerable difficulty. Therefore, it is necessary to control or adjust the amount of oxygen to be contained in titanium in accordance with the purpose for which the titanium is to be used.

In accordance with the prior art, a titanium metal of the sponge type, which has been obtained by reducing titanium tetrachloride ($TiCl_4$) with metallic magnesium or sodium, is heated and fused with a suitable amount of titanium oxide ($TiO_2$) to produce titanium containing a predetermined amount of oxygen and, hence, having a predetermined hardness. However, in the foregoing process, the reduction of the titanium tetrachloride with metallic magnesium or sodium is a batch process which has to be performed in a sealed container, and considerable difficulty is experienced in separating the resulting titanium metal from the magnesium chloride or sodium chloride that is a by-product of the reaction.

In order to avoid the above problems, the present inventors along with others have previously proposed, for example, as disclosed in Japanese Patent No. 726,754 and Japanese Patent Applications No. 107,500/74 and 141,960/74, an electrolytic method by which a titanium metal is directly obtained by electrodeposition on an electrode as a compact block or plate having a smooth surface. However, in such known method for obtaining titanium metal by electrolysis, it is difficult or almost impossible to adjust the hardness of the electrodeposited titanium.

OBJECTS AND SUMMARY OF THE INVENTION

Accordingly, it is an object of this invention to provide a method by which the hardness of a titanium metal can be adjusted at the same time as such titanium metal is being obtained directly by electrodeposition.

Another object is to provide a method by which the hardness of a titanium metal can be adjusted to a desired value as such titanium metal is being obtained by the so-called fused-salt electrodeposition method.

In accordance with an aspect of this invention, a titanium metal obtained by electrodeposition from an electrolyte containing one or more dissolved or fused salts which include at least a titanium chloride has its hardness adjusted by including in the electrolyte at least one oxide selected from the group consisting of titanium oxide and oxides of alkaline and alkaline-earth metals. Further, in order to increase the solubility of the oxide in the electrolyte, at least one fluoride selected from fluorides of alkaline and alkaline-earth metals is preferably also added to the electrolyte.

DESCRIPTION OF THE PREFERRED EMBODIMENTS

The present invention will be described as applied to the method disclosed in Japanese Patent No. 726,754 and Japanese Patent applications No. 107500/74 and 131,960/74 for electrodepositing a titanium metal onto a cathode electrode from an electrolyte containing titanium chloride and one or more chloride salts of alkaline and alkaline-earth metals, and in which the electrolytic operating conditions are selected to adjust the polarization at the surface of the cathode electrode so that the titanium electrodeposited thereon will have a flat surface. In general, in accordance with this invention, the electrolyte used in the above method has at least one oxide selected from the group consisting of titanium oxide and oxides of alakline and alkaline-earth metals, such as, calcium oxide and the like, dissolved or fused in the electrolyte. In order to increase the solubility of the oxide or oxides, at least one fluoride of an alkaline or alkaline-earth metal, such as, calcium fluoride, potassium fluoride and the like, is further added to the electrolyte. During the electrodeposition, the dissolved oxide is contacted with the surface of the cathode electrode on which the titanium is being deposited so that such electrodeposited titanium has oxygen uniformly distributed therein, as a contaminant, for determining the hardness of the electrodeposited titanium.

In general, when concave and convex portions are formed on the surface of an electrodeposited material during the electrodeposition, the current density at the convex portion is apt to become higher than that at the concave portion. As a result, the rate of electrodeposition at the convex portion becomes higher than that at the concave portion, and accordingly the surface of the electrodeposited material acquires a marked roughness. Further, dendritic crystallines or powders are formed on the surface of the electrodeposited material. If such concave and convex portions or dentritic crystals are formed on the surface of a material electrodeposited from a fused-salt bath containing dissolved oxygen, the cathode current density becomes greatly different not only between the top and base parts of the dendritic crystals but also between the concave and convex portions. Further, the degree of contact of fresh electrolyte containing dissolved oxide becomes different from the concave and convex portions and for the base and top parts of the dendritic crystals. Therefore, the amounts of oxygen contained in the electrodeposited titanium, as a contaminant, become different at the concave and convex portions of its surface. In other words, titanium containing oxygen homogeneously cannot be obtained and, accordingly, the amount or concentration of oxygen in the titanium cannot be adjusted desirably so long as the electrodeposited titanium does not have a flat surface.

However, the previously mentioned Japanese Patent No. 726,754 discloses a method in which the composition of the electrolyte and the conditions for the electrodeposition are selected to provide means, such as polarization, for suppressing the rate of electrodeposition at the convex portions relative to that at the concave portions so that a flat surface can be obtained on a material continuously electrodeposited from a fused-salt bath.

Accordingly, the present invention, that is, the addition of one or more dissolved oxides to the electrolyte, is preferably applied to the electrodeposition method disclosed in Japanese Patent No. 726,754 so that the degree of contact of the electrolyte with the surface of the electrodeposited material can be made uniform to ensure that the oxygen contained in the electrodeposited titanium, as a contaminant, will be homogeneously distributed in respect to the entire surface thereof. Further, by adjusting the concentration of, for example, dissolved oxide, in the electrolyte, the amount of oxygen contained in the electrodeposited titanium can be varied for similarly varying the hardness of the obtained titanium, as desired.

Before proceeding with a detailed description of illustrative examples of the invention, a description will be given of an existing method which will be used as a reference for comparison with the method embodying this invention.

REFERENCE 1

(1) Conditions of Electrodeposition
(A) Electrolyte (molar ratio)
$BaCl_2$ — 24.9
$MgCl_2$ — 25.4
$CaCl_2$ — 12.6
NaCl — 41.0
KCl — 18.3
$TiCl_2$ — 23.4
$TiCl_3$ — 1.7
(B) Temperature and Time of Electrodeposition
470° C & 1 hour
(C) Electrodes
Electrode for electrodeposition (cathode)
Stainless Plate
Length of immersed portion: 25 mm.
Width of immersed portion: 10 mm.
Thickness of immersed portion: 0.3 mm.
Counter electrode (anode)
Carbon Plate
Length of immersed portion: 50 mm.
Width of immersed portion: 30 mm.
Thickness of immersed portion: 5 mm.
(D) Electrolytic Current
Kind of Current
Intermittent DC current: 1.3A
Period of each intermittent current being supplied: 0.24 sec.
Interval between successive intermittent currents: 0.36 sec.
(E) Stirring of Electrolytic Bath
Stirring is carried out by vibration of cathode electrode during electrodeposition thereon. Vibration Condition
Amplitude of Vibration: about 3 cm.
Frequency of Vibration: 400/min.
(2) Treatment of Electrodeposited Material
Electrodeposited Material produced under the above condition is removed from the bath, immersed in a 2.5 wt.% aqueous solution of hydrochloric acid to remove the electrolyte adhered to the electrodeposited material, and then is washed with water and finally is dried.
(3) Shape of Electrodeposited Material
The electrodeposited material obtained by the above method is somewhat swollen along its edge due to the concentration of current density but flat at the major center portion thereof.
(4) Composition of Electrodeposited Material
Analysis of the thus obtained electrodeposited material by means of an atomic absorption flame spectrophotometer and X-ray micro-analyzer indicates that such material corresponds to first grade sponge titanium in JIS (Japanese Industrial Standard).
(5) Lattice Constant of Electrodeposited Material
The result of measuring the lattice constant of the electrodeposited material is as follows:

$a$ = 2.9504A, C = 4.6835 to 4.6840A

These values correspond to those of pure titanium and hence show that the material or metal obtained contains almost no interstitial oxygen or the like.
(6) Hardness of Electrodeposited Material
The hardness of electrodeposited material, as measured by the micro Vicker's method under a load of 100g, is as follows:

84.7 to 89.4

This value corresponds to that of best pure titanium in the prior art.

Specific examples of the present invention will now be described:

EXAMPLE I (1) Condition of Electrodeposition
The conditions (B), (C), (D) and (E) of Reference 1 are employed for this Example of the invention.
(A) Electrolyte
0.07 weight % of $TiO_2$ and 1.12 weight % of KF are added to the electrolyte of Reference 1.
(2) Treatment of Electrodeposited Material
Same as in Reference 1
(3) Shape of Electrodeposited Material
The electrodeposited material is somewhat swollen along its edge but flat at its major center portion as in the case of Reference 1.
(4) Composition of Electrodeposited Material
Analysis of the electrodeposited material by means of an atomic absorption flame spectrophotometer and X-ray micro analyzer indicates that the obtained material corresponds to first grade sponge titanium in JIS except as to oxygen.
(5) Lattice Constant of Electrodeposited Material
The result of measuring the lattice constant of the electrodeposited material is as follows:

$a$ = 2.9505 A, C = 4.687 to 4.6853 A

The reason why the value $a$ of Example I is approximately the same as that of Reference 1, but the value C is much different from that of Reference 1, is that the electrodeposited material of Example 1 contains interstitial oxygen.
(6) Hardness of Electrodeposited Material
The hardness of electrodeposited material, as measured by the micro Vicker's method under a load of 100 g, is as follows:

140 to 150

This value is higher than that of Reference 1 by about 50 to 60.

EXAMPLE II (1) Condition of Electrodeposition

The conditions (B), (C), (D) and (E) of Reference 1 are employed for this Example.

(A) Electrolyte 0.07 weight % of $TiO_2$, 0.93 weight % of CaO, 1.7 weight % of $CaF_2$ and 1.12 weight % of KF are added to the electrolyte of Reference 1.

(2) Treatment of Electrodeposited Material

Same as in Reference 1

(3) Shape of Electrodeposited Material

The electrodeposited material is somewhat swollen along its edge but flat at its major center portion, as in the case of Reference 1.

(4) Composition of Electrodeposited Material

Analysis of the electrodeposited material by means of an atomic absorption flame spectrophotometer and X-ray micro analyzer indicates that the obtained material corresponds to first grade sponge titanium in JIS except as to oxygen.

(5) Lattice Constant of Electrodeposited Material

The result of measuring the lattice constant of the electrodeposited material is as follows:

$a = 2.9505$ A, C – 4.6887 A

The reason why the value $a$ is approximately the same as that of Reference 1, but the value C is much greater than that of Reference 1, is that the electrodeposited material of Example II contains the interstitial oxygen.

(6) Hardness of Electrodeposited Material

The hardness of the electrodeposited material, as measured by the micro Vicker's method under a load of 100 g, is as follows:

188 to 200

This value is greater than that of Reference 1 by about 100.

It will be apparent from the above examples of this invention that the addition of one or more oxides and/or fluorides to the electrolyte greatly increases the hardness of the material electrodeposited therefrom by reason of the fact that oxygen is present as a contaminant in such electrodeposited material. The presence of oxygen in the electrodeposited materials obtained in the above examples of the invention can be ascertained by comparison of the analysis and lattice constants of such materials with the analysis and lattice constant of the material electrodeposited in Reference 1, that is, when neither oxides nor fluorides are added to the electrolyte or the bath containing the same. In the case where the electrolyte is composed only of chlorides, as in Reference 1, the resulting electrodeposited titanium contains only that amount of oxygen as is typical of the best pure titanium of the prior art. On the other hand, since a substantial amount of oxygen is present in the electrodepsoited titanium obtained from the bath containing the electrolyte to which one or more oxides and/or one or more fluorides have been added, it will be apparent that the addition of such oxide and/or fluoride serves to increase the amount of dissolved oxide in the electrolyte or bath.

Further, the amount of disolved oxide in the bath is determined by the electrolyte composition and the temperature of the electrolyte in the bath. More specifically, the amount of dissolved oxide in the bath is increased with increasing temperature, preferably in the range from 450° C to 520° C, so that the amount of oxygen in the titanium obtained by electrodeposition can be adjusted desirably by controlling the temperature of the bath and the other electrolytic conditions. Therefore, it will be seen that the hardness of the metal titanium can be adjusted desirably.

Further, it will be understood that if during the electrodeposition of the titanium, the temperature of the bath is changed to vary the amount of dissolved oxide in the electrolyte and/or the other electrolytic conditions are varied, the amount of oxygen contained in the electrodeposited titanium is changed from time to time to obtain a lamination of titanium layers having different hardnesses.

If several electrolytic current is intermittently produced in addition to the electrolytic current during the electrodeposition according to this invention, the oxide dissolved in the electrolyte in the bath is electrolyzed and hence oxygen is produced on the surface of the electrodeposited material. Thus, the amount of oxygen in the electrodeposited material and its hardness can be further adjusted, as will be easily understood without further explanation.

Generally speaking, in the fused-salt electrodeposition of titanium chloride, the electrolyte is isolated from the air to avoid its oxidization. However, in fact, the electrolyte is oxidized somewhat during electrolysis and titanium oxide is produced in the electrolyte. In such a case, it may not be necessary to add further titanium oxide to the electrolyte for the practice of this invention.

Although illustrative examples of the invention have been specifically described herein, it is to be noted that the invention is not limited to those precise examples, and that various changes and modifications may be effected therein by one skilled in the art without departing from the scope or spirit of the invention as defined in the appended claims.

What is claimed is:

1. In the method of electrodepositing a substantially flat deposit of titanium metal onto a cathode from a fused salt electrolyte containing titanium chloride and at least one chloride salt of alkaline and alkaline-earth metals; the improvement of increasing the hardness of the electrodeposited titanium metal by dissolving in said fused salt electrolyte about 0.07 wt.%, based on the balance of the electrolyte, of at least titanium oxide from the group consisting of titanium oxide and oxides of alkaline and alkaline-earth metals, and adding to the fused electrolyte about 1.12 wt.% of potassium fluoride for increasing the solubility of each said oxide in the fused electrolyte so that, during the electrodeposition, the dissolved oxide is contacted with the surface of said cathode for distributing interstitial oxygen within the electrodeposited titanium metal and thereby increasing the hardness of the latter, as measured by the micro Vicker's method, to the range of from bout 140 to about 200, while providing the electrodeposited titanium metal with a lattice constant of about $a=2.9505$A and about C=4.6853A to 4.6887A.

2. The method according to claim 1; in which CaO and $CaF_2$ are also added to the fused electrolyte.

3. The method according to claim 2; in which the amounts of said CaO and $CaF_2$ added to the fused electrolyte are approximately 0.93 wt.% and 1.7 wt.%, based on the balance of the electrolyte.

4. The method according to claim 1; in which said electrolyte contains, in addition to said titanium chloride, $BaCl_2$, $MgCl_2$, $CaCl_2$, NaCl and KCl.

5. The method according to claim 1; in which the electrodeposition is carried out with the temperature of said electrolyte in the range between approximately 450° C. and 520° C. for adjusting the amount of oxide dissolved in said electrolyte.

6. The method according to claim 1; in which the electrodeposition is effected with an intermittent electrolytic current.

7. The method according to claim 1; in which said electrolyte is stirred during the electrodeposition of the titanium metal therefrom.

8. The method according to claim 1; in which the titanium metal is electrodeposited on a cathode electrode to which movements are imparted during the electrodeposition.

* * * * *